United States Patent [19]

Schulz et al.

[11] 4,103,381

[45] Aug. 1, 1978

[54] HYDRAULIC MOTOR

[75] Inventors: Otto W. Schulz, San Diego, Calif.; Tor Jan Pedersen, Hellandsbygd, Norway

[73] Assignee: Randolph C. H Michaelson, Malibu, Calif.

[21] Appl. No.: 824,057

[22] Filed: Aug. 12, 1977

[51] Int. Cl.[2] ..... A46B 13/06

[52] U.S. Cl. ..... 15/29; 15/97 R; 173/168; 418/266

[58] Field of Search ..... 15/24, 29, 97 R; 418/143, 148, 233, 266, 221; 173/59, 72, 163, 168

[56] References Cited

U.S. PATENT DOCUMENTS

| | | | |
|---|---|---|---|
| 2,330,565 | 9/1943 | Eckart | 418/266 X |
| 2,382,591 | 8/1945 | Warren | 418/266 X |
| 2,395,092 | 2/1946 | Bertoglio | 418/221 X |

FOREIGN PATENT DOCUMENTS

| | | | |
|---|---|---|---|
| 990,715 | 4/1965 | United Kingdom | 418/266 |

*Primary Examiner*—Edward L. Roberts
*Attorney, Agent, or Firm*—Christie, Parker & Hale

[57] ABSTRACT

A hydraulic motor has a sliding-vane circular rotor disposed in a substantially elliptically cylindrical rotor chamber formed in a body to which the rotor is rotatably mounted so as to define a pair of diametrically opposed arcuate work cavities. Working fluid is introduced under pressure to each of the cavities via an inlet port, and spent working liquid is withdrawn from each cavity via an exit port. Each exit port is displaced angularly from the inlet port in the direction of rotation of the rotor. The rotor carries a sufficient number of radially movable, spring biased vanes, which are slidably engageable with the walls of the chamber, that at least one vane is always disposed in cavity-dividing position in each cavity for application thereto of pressure of liquid in the cavity between the vane and the inlet port. Working liquid pressure is applied to the vane to urge the vane toward the outlet port and to turn the rotor about an axis of rotation thereof. Such a motor is characterized in that the body defines a pair of annular spaces concentrically of the rotor chamber at axially displaced locations in the body adjacent the corresponding opposite axially spaced ends of the rotor chamber. The motor comprises means for supplying working liquid to one of the spaces. The inlet ports communicate from the one space to the respective cavities. The outlet ports communicate from the respective cavities to the other spaces. Liquid is discharged from the other space substantially parallel to the axis of the body.

7 Claims, 8 Drawing Figures

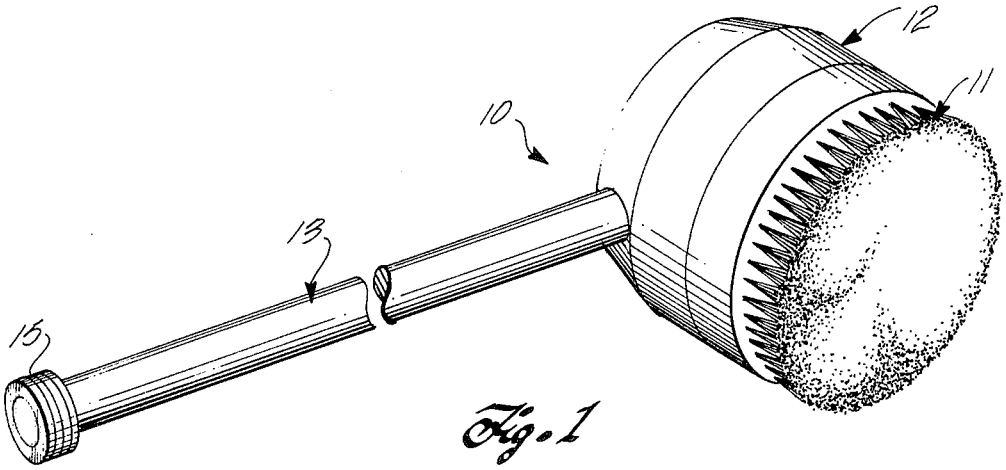
Fig. 1
Fig. 2
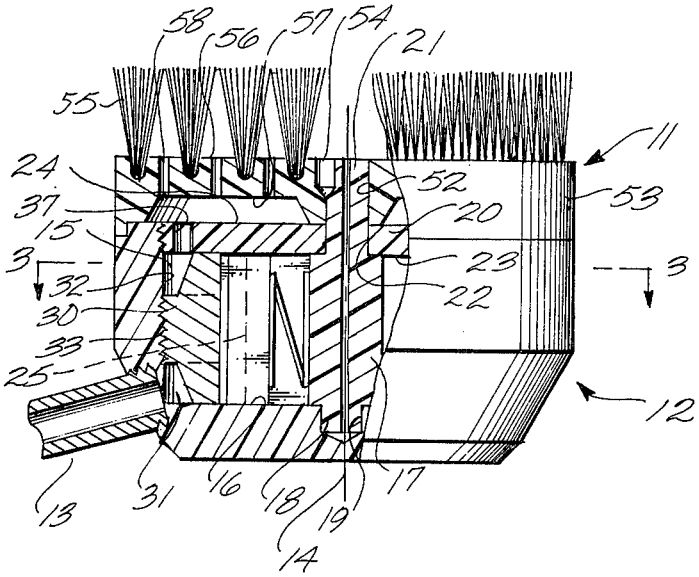

Fig. 3
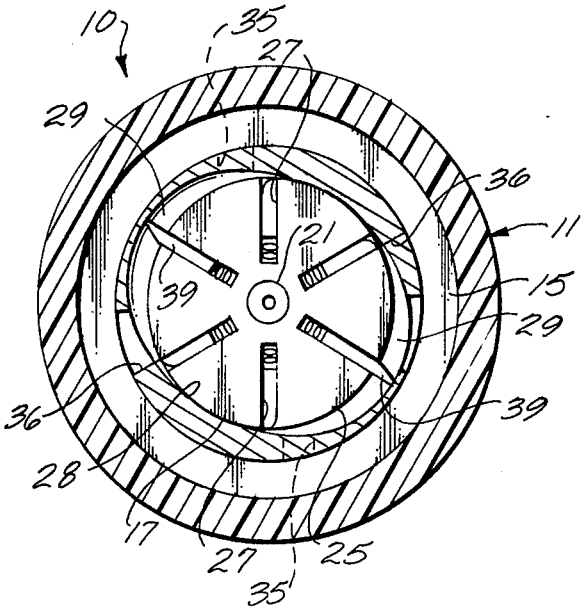
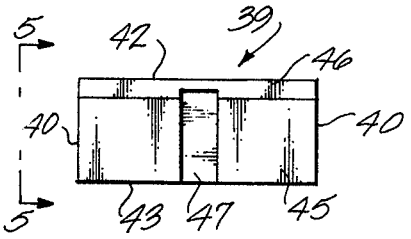
Fig. 4
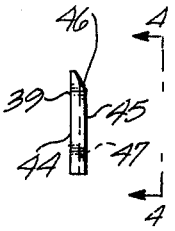
Fig. 5
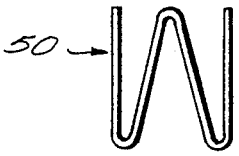
Fig. 6
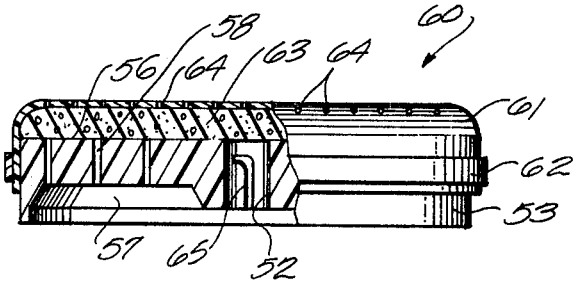
Fig. 7
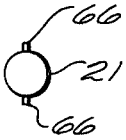
Fig. 8

HYDRAULIC MOTOR

BACKGROUND OF THE INVENTION

1. Field of the Invention

This invention pertains to hydraulic motors. More particularly, it pertains to hydraulic motors in which spent hydraulic or working fluid is discharged from the motor substantially parallel to the axis of the motor rotor.

2. Background of the Invention

There are many domestic, commercial and industrial applications in which hydraulic or water motors may be used to advantage. Water motors can be used where brushing or polishing tasks are to be performed in the presence of water, either as such or as a solvent or carrier for a detergent, polishing compound or the like.

Hydraulic motors previously known are large, cumbersome and expensive devices. Such characteristics of existing water motors detract from their use in situations where such motors might otherwise be used to considerable advantage. Thus, in domestic applications, water motors could be, but are not presently, used extensively in car washing, floor washing, and other uses. Similarly, in commercial and industrial applications the size and weight of known water or hydraulic motors complicates many polishing operations.

One cause for the disadvantages of existing or previously described water motors has been in the inability to produce a compact, light-weight, water motor which can be grasped in one hand and which can be used effectively with relatively low water pressures, such as the water pressures typically encountered in residential situations. Also, known or previously described water motors are inefficient in terms of the amount of torque which they can generate for a given level of pressure of applied working liquid. As a result, currently available or previously described water motors are generally unacceptably large and complicated.

A need exists for a lightweight, simple, effective, efficient, and economic hydraulic motor capable of producing relatively high torque levels in terms of applied working liquid pressure. The satisfaction of this need will result in the provision of a product of considerable utility in domestic, commercial and industrial applications.

In the preparation of the present document, the following U.S. patents were specifically considered: U.S. Pat. Nos. 2,395,092, 2,806,236, 3,626,265, 3,824,045, 3,864,780 and 3,865,085.

SUMMARY OF THE INVENTION

This invention satisfies the need identified above by providing a simple, effective, efficient and economic hydraulic motor which produces relatively high torque in terms of applied working liquid (water) pressures. The motor is of simple structural organization and is therefore economic to manufacture. Economy in manufacture in turn produces a low selling price, whereby the present water motor is suited for widespread domestic, commercial, and industrial usages.

Generally speaking, this invention provides improvements in hydraulic motors of the type in which a sliding-vane circular rotor is disposed in a substantially elliptically cylindrical rotor chamber formed in a body to which the rotor is centrally rotatably mounted to define a pair of diametrically opposed arcuate work cavities. A working liquid, such as water, is introduced to each work cavity under pressure via an inlet port, and spend liquid is drawn from each cavity via an exit port. Each exit port is displaced angularly from the inlet port in the direction of rotation of the rotor. The rotor carries a sufficient number of radially movable, spring biased vanes, slidably engaging the walls of the chamber, that at least one vane is always disposed in cavity-dividing position in each cavity. The pressure of liquid in the cavity between the vane and the inlet port is applied to the vanes in the cavities. In this manner, working liquid pressure is effective upon the vane to urge the vane toward the outlet port of the corresponding cavity, thereby to turn the rotor about an axis of rotation thereof. In this context, the improvement provided by this invention is characterized in that the body defines a pair of annular spaces concentrically of the rotor chamber at axially displaced locations in the body adjacent the corresponding opposite axially spaced ends of the rotor chamber. The improvement further comprises means for applying working liquid to one of these annular spaces. The inlet ports communicate from the one space to the respective cavities. The outlet ports communicate from the respective cavities to the other of the annular spaces. Means are provided for discharging liquid from the other annular space substantially parallel to the axis of the rotor.

Suitable implements or tools are connectible to the rotor externally of the motor to be turned or otherwise driven in response to rotation of the rotor. Spent liquid from the motor preferably is passed through the implement or tool, such as a brush or polishing implement.

DESCRIPTION OF THE DRAWINGS

The above-mentioned and other features of this invention are more fully set forth in the following detailed description of a presently preferred embodiment of the water motor, which description is presented with reference to the accompanying drawings, wherein:

FIG. 1 is a perspective view of a presently preferred water motor according to this invention;

FIG. 2 is an elevation view, partially in cross-section, of the water motor shown in FIG. 1;

FIG. 3 is a cross-section view taken along line 3—3 in FIG. 2;

FIG. 4 is an elevation view of a slidable vane of the water motor;

FIG. 5 is an end view of the vane shown in FIG. 4;

FIG. 6 is a plan view of a vane biasing spring;

FIG. 7 is an elevation view, partially in cross-section, of a polishing accessory for the water motor; and FIG. 8 is an end view of the rotor output shaft of another water motor according to this invention.

DESCRIPTION OF THE ILLUSTRATED EMBODIMENT

A water motor 10 according to this invention, equipped with a brush attachment 11, is shown in FIG. 1. The water motor has a generally circularly cylindrical body 12. A rigid water supply pipe and handle 13 is connected to body 12 at a rear portion thereof and extends, as shown in FIG. 2, at an angle to the central axis 14 of the body. Preferably the angle between the elongate extent of handle 13 and axis 14 is about 75°. The handle is externally threaded at its end 15 opposite from the motor body to adapt it to be engaged to a hose or other similar flexible water supply conduit.

As shown in FIGS. 2 and 3, the components of motor 11 preferably are fabricated of synthetic material, such as an injection molded plastic or the like. Nylon or other synthetic resin, which has good self-lubricating properties in the presence of water, is a preferred material for the fabrication of motor 10.

The circularly cylindrical body 12 of the motor defines a circularly cylindrical internal cavity having a flat rear or bottom surface 16 perpendicular to axis 14. A circularly cylindrical rotor 17, having a circularly cylindrical principal portion 25, is disposed within the body coaxially of axis 14. The rotor is rotatably mounted to the body by cooperation of a stub axle 18, formed integral with the rotor, cooperating in a corresponding recess 19 formed in the body and opening through the cavity end wall 16. A flat circular closure plate 20 is threadably engaged with the body to enclose cavity 15 and to provide further rotatable support for rotor 17. Accordingly, the rotor has an output shaft 21 which extends through a corresponding bearing hole 22 in the closure plate to project from the motor body and, as shown in FIG. 2, to receive whatever tool, cleaning implement or other accessory is used with the motor. The closure plate has a flat rear surface 23 and a parallel flat outer surface 24. Body surface 16 and closure plate surface 23 define the opposite parallel axially spaced end walls of cavity 15. The right circular cylinder rotor principal portion 25 has a length along axis 14 which is only slightly less than the spacing between cavity end surfaces 16 and 23; thus, the ends of the rotor portion 25 cooperate closely with cavity end walls 16 and 23.

A plurality of radial slots 27 are formed in the rotor cylinder and open to the rotor outer diameter as shown best in FIG. 3. The slots extend from end to end of rotor portion 25. Slots 27 are spaced equidistantly about the circumference of the rotor.

The circularly cylindrical rotor is disposed within a substantially elliptically cylindrical rotor chamber 28 defined within the motor body, chamber 28 being centered on axis 17. The minor diameter of chamber 28 corresponds to the diameter of rotor 17. Accordingly, as shown in FIG. 3, the positioning and sizing of the rotor within elliptical chamber 28 divides chamber 28 into two arcuate, diametrically opposed, work cavities 29.

The term "cylindrical" is used in its broad mathematical (analytical geometry) sense with reference to chamber 28. According to this dictionary definition of "cylinder", a cylinder is a surface defined in spaceby a line (the generatrix) moving at all times parallel to a fixed line (the directrix). If the path traced by the generatrix, as it moves relative to the directrix, is an ellipse, then the surface generated by the generatrix is an elliptical cylinder. From FIG. 3 it will be observed that the cross-sectional configuration of cylinder 28 in a plane normal to axis 14 is not a true ellipse since between arcuate work cavities 29, the contour of chamber 28 is circular to conform to the outer configuration of rotor portion 25.

Chamber 28 is not defined by motor body 12 per se. Instead, as shown in FIGS. 2 and 3, it is defined by an annular collar 30 which is disposed within body cavity 15 circumferentially about rotor 17. The outer overall contour of collar 30 is circular. The central opening of the collar defines the side walls of elliptically cylindrical rotor chamber 28. The upper and lower outer portions of collar 30 are circumferentially recessed as shown in FIG. 2. Accordingly, when the collar is disposed within the body, so that one end face thereof mates snugly with rear wall 16 of body cavity 15, and closure plate 20 is engaged in the body in snug mating relationship with the other face of the collar, a pair of annular spaces 31 and 32 are defined in the body circumferentially about rotor chamber 28. Between spaces 31 and 32, the outer circumference of collar 30 is intimately engaged with body 12 as by cooperating threads 33. As a result, spaces 31 and 32 are defined in the body adjacent to the corresponding opposite axially-spaced ends 16 and 23 of the rotor chamber.

The pipe which defines handle 13 is connected to body 12 so that the interior of the pipe communicates to space 31 adjacent the rear of the motor body. This is shown in FIG. 2. Space 31 is therefore a working liquid supply manifold or plenum within the motor. Working fluid is supplied from space 31 to working cavities 29 via a pair of diametrically opposed inlet ports 35 (see FIG. 3) defined through collar 30 adjacent to rotor chamber end wall 16. Spent working liquid is withdrawn from the working cavities to space 32 via a pair of diametrically opposed outlet ports 36 defined through the collar adjacent to rotor chamber end wall 23. Space 32 therefore is a spent working liquid manifold or plenum within the motor. Spent working liquid is then discharged from the motor through a plurality of openings 37 formed through closure plate 20 at spaced locations around the plate and so positioned that the openings communicate to space 32. The openings are directed generally parallel to the motor axis 14.

The working cavity inlet and outlet ports are defined at the opposite ends of the respective working cavities, and the outlet port is displaced from the inlet port in the direction of rotation of the rotor during operation of the motor which direction is counterclockwise in FIG. 3.

A plurality of vanes 39, corresponding in number to the number of radial slots 27 defined in the rotor, are also components of motor 12. One vane is disposed in each slot, as shown in FIGS. 4 and 5 which are elevation and end views of a vane 39. Each vane has opposite parallel end surfaces 40 which are spaced apart a distance essentially equal to but slightly less than the spacing between rotor chamber end walls 16 and 23. Each vane also has parallel longitudinal edges 42 and 43 which become the outer and inner edges of the vanes when the vanes are disposed in the rotor slots. The distance between vane edges 42 and 43 is less than the depth of rotor slots 27. The thickness of each vane, as seen in FIG. 5, is less than the width of the rotor slots as viewed in FIG. 3. Accordingly, the vanes, when disposed in the rotor, are freely slideable in a reciprocal manner into and out of the slots. Each vane has a forward surface 44 and a rear surface 45, the rear surface of the vane being shown in FIG. 4. As shown best in FIGS. 4 and 5, the rear surface 45 of each vane, adjacent to its outer edge 42, is relieved, as at 46, in a manner resembling a chamfer. The outer surface of the vane between the relief 46 and its forward surface 44 is rounded, as shown in FIG. 5. A recess 47 is formed in the rear surface 45 of each vane midway between end edges 40, from rear edge 43 into relief 46 as shown in FIG. 4. A vane bias spring 50, having a generally W-shape configuration as shown in FIG. 6, is disposed between the inner edge 43 of each vane and the inner end of each vane slot 27, as shown in FIG. 3. Springs 50 lightly urge the vanes radially outwardly of the rotor in the corresponding slots, thereby to urge the outer edges of the vanes into intimate sliding contact with the elliptically cylindrical walls of rotor chamber 28. The springs 50 need exert only a light bias force on the vanes to enable start-up of the motor. During operation of the motor, centrifugal forces urge the vanes into contact with the side walls of the rotor chamber.

The number of vanes slidably carried by the rotor is sufficient that, regardless of the position of the rotor angularly in the motor, there is always at least one vane which has its outer extent disposed in each working cavity 29 in a cavity-dividing position between the inlet and outlet ports of the working cavity. Therefore, the working liquid which is introduced into the working cavities under pressure operates upon the vanes to urge those vanes which are in cavity-dividing position to move toward the cavity outlet ports and thereby turn the rotor about axis 14. Six vanes are provided in motor 10, but it is within the scope of this invention that more or less vanes may be present so long as the conditions set forth above are met. Thus, if desired, eight vanes may be carried by the motor rotor. As shown in FIG. 3, the vanes are disposed in slots 27 so that the forward surface 44 of each vane which is disposed in work cavity-dividing position faces toward the inlet port of such cavity. The relief 46 on each vane faces toward the direction in which the rotor moves, thereby enhancing the ability of the vane to follow the contour of rotor chamber 28 as the rotor turns.

It is an important feature of this invention that annular spaces 31 and 32 of the water motor are disposed circumferentially of the rotor chamber adjacent the opposite ends of the chamber. In this way, the spaces can be made of essentially equal diameter, thereby reducing the overall diameter of the motor. The organization of the motor shown in U.S. Pat. No. 2,395,092 is to be contrasted to the arrangement of motor 10 in this regard. It is also important that spent water from the rotor chamber is discharged from the motor in a direction generally parallel to motor axis 14. This axially parallel discharge of spent working liquid makes it possible to use the spent working liquid directly in conjunction with brush 11 or other tool or implement connected to motor output shaft 21. This situation is shown best in FIG. 2. Again, contrast the more complex arrangement shown in U.S. Pat. No. 2,395,092.

As shown in FIG. 2, brush accessory 11 for motor 10 is coupled directly to motor output shaft 21 via a central hole 52 in a brush base disc 53, which disc is keyed to and axially secured on the motor output shaft by a set screw 54. A plurality of bristle groups 55 extend from an obverse face 56 of the brush base at selected locations over an annular area which encompasses substantially all of the area of the brush disc. The brush disc has a reverse face, which is recessed to define, with motor closure plate face 24, a chamber 57 to which working liquid exhaust openings 37 open as shown in FIG. 2. A plurality of holes 58 are formed through the brush disc from chamber 57 at locations between the bristle groups. The brush disc has an outer diameter which is essentially equal to the outer diameter of motor body 12. Disc 53 preferably has a circumferential flange extending from its rear portion parallel to the motor axis for cooperation with a recess formed in the upper outer periphery of the motor body, as shown in FIG. 2. In this manner, chamber 57 is effectively sealed so that all water introduced into the chamber through exhaust openings 37 must flow through holes 58 in the brush disc. Similarly, all of the discharge liquid from the motor is introduced into chamber 57.

Water motor 10, when equipped with brush accessory 11, is ideally suited for use in myriad washing and scrubbing operations. For example, the water motor, when so equipped, may be used as a car-washing implement or as a powered bath brush. Many other uses of the motor/brush combination are possible, depending upon the composition and stiffness of the brush bristle material.

It will be noted that the entire brush structure of attachment 11 is rotated by operation of motor 10. This situation is contrasted to that shown in U.S. Pat. No. 3,864,780 in which only a central portion of an overall brush is driven by a paddlewheel-type hydraulic motor, with assistance from an electric motor due to the inefficiency of a paddlewheel-type hydraulic motor.

Another feature of motor 10 is that it has radially balanced loads applied to it by the working fluid in view of their being two working cavities in the motor. Thus, rotor 17 is not inherently subjected to eccentric loads. This simplifies the rotatable mounting of the rotor in the motor, and prolongs its useful life, and increases its efficiency.

A pad accessory 60 for water motor 10 is shown in FIG. 7. This accessory has a base disc 53 which is essentially identical to brush accessory 11 shown in FIG. 2. A piece of chamois leather or other suitable membrane 61 is secured to the disc 53 by an encircling band or strap 62 so as to overlie the obverse surface 56 of the disc. A quantity of porous padding material 63 is disposed between the brush disc and the reverse surface of the membrane across the entire extent of the disc. A substantial plurality of small holes 64 are formed through the membrane material to render the membrane porous. The total area of holes 64 is at least equal to the total area of openings 58 through the disc 53, and the total area of openings 58 is at least equal to the total area of exhaust openings 34 through motor closure plate 20. In this manner, the brush or pad accessories connected to the motor output shaft do not provide any substantial impediment to the flow of working fluid through the motor; this further contributes to the efficiency of the motor.

FIG. 7 also illustrates another manner in which an accessory can be attached to the motor output shaft. Disc 53 of pad accessory 60, like that of brush accessory 11, has a central hole 52 which is of slightly larger diameter than the diameter of the motor output shaft. However, in the chamois accessory, a pair of L-slots 65 are formed in the walls of hole 52 at diametrically opposed locations for cooperation with a pair of diametrically opposed projecting pins 66 carried by the end of the rotor output shaft 21, as shown in FIG. 8. The pins are engaged in L-slots 65 to secure the accessory axially and angularly to the motor shaft. The orientation of the L-slots in hole 52 is such that, in use, the load applied to disc 53 causes it to tend to lag the motor shaft and to urge the pins 66 into the closed ends of the L-slots. The L-slot arrangement is a preferred mode of connecting an accessory or tool to the motor in cases where the nature of the accessory precludes or makes inconvenient the use of a set screw as in brush 11.

Workers in the art to which this invention pertains will recognize that the preceding description has been of a presently preferred embodiment of the hydraulic motor and of selected preferred accessories for it. Thus, the foregoing description is not and is not intended to be exhaustive of all forms which this invention may take. Modifications and alterations to the described structure may be made within the fair scope of this invention.

Thus, the preceding description should not be taken as limiting the fair scope of this invention.

What is claimed is:

1. A hydraulic motor in which a circular sliding-vane rotor is centrally disposed in a substantially elliptically cylindrical rotor chamber formed in a body to which the rotor is rotatably mounted to define a pair of diametrically opposed arcuate work cavities to each of which a working liquid is introduced under pressure via an inlet port and from which spent liquid is withdrawn via an exit port displaced angularly from the inlet port in the direction of rotation of the rotor, the rotor carrying a sufficient number of radially movable spring-biased vanes slidably engaging the walls of the chamber that at least one vane is always disposed in cavity-dividing position in each cavity for application thereto of pressure of liquid in the cavity between the vane and the inlet port, thereby to urge the vane toward the outlet port and to turn the rotor about an axis of rotation thereof, and characterized in that the body defines a pair of annular spaces concentrically of the rotor chamber at axially displaced locations in the body adjacent the corresponding opposite axially spaced ends of the rotor chamber, and comprising means for supplying working liquid to one of the spaces, the inlet ports communicating from the one space to the respective cavities, the outlet ports communicating from the respective cavities to the other of the spaces, and means for discharging liquid from the outer space substantially parallel to the axis of the rotor.

2. A hydraulic motor according to claim 1 wherein the annular spaces are of substantially equal diameter.

3. A hydraulic motor according to claim 1 including an output shaft connected to the rotor coaxially thereof and extending from the body adjacent said other space, and wherein the discharging means are defined through a wall of the body through which the output shaft extends.

4. A hydraulic motor according to claim 3 and an implement connectible to the output shaft for rotation therewith, the implement having a circular base having a reverse side defining an annular recess therein of lesser outer diameter than the disc, the disc being connectible to the output shaft in such manner that the reverse side of the disc outwardly of the recess cooperates closely with said body end wall and the recess defines with said end wall a chamber to which the discharge means communicate, and a plurality of liquid flow openings through the disc from the recess to an obverse side of the disc.

5. A hydraulic motor according to claim 4 wherein the discharge means are arranged to discharge liquid from said other space only to the chamber defined by the recess in the implement disc upon connection of the disc to the output shaft.

6. A hydraulic motor according to claim 4 wherein the implement is a brush and comprises a plurality of bristles carried by the disc and extending from the obverse side thereof.

7. A hydraulic motor according to claim 4 wherein the implement includes a porous membrane disposed across the obverse side of the disc, the total porosity of the membrane being at least equivalent to the liquid flow area of said openings.

* * * * *